US006082459A

United States Patent [19]

Rogers et al.

[11] Patent Number: 6,082,459

[45] Date of Patent: Jul. 4, 2000

[54] DRILL STRING DIVERTER APPARATUS AND METHOD

[75] Inventors: Henry E. Rogers; Donald F. Hushbeck, both of Duncan, Okla.

[73] Assignee: Halliburton Energy Services, Inc., Duncan, Okla.

[21] Appl. No.: 09/106,484

[22] Filed: Jun. 29, 1998

[51] Int. Cl.[7] ..... E21B 33/129

[52] U.S. Cl. ..... 166/334.1; 166/334.4; 166/185; 166/331

[58] Field of Search ..... 166/185, 332.1, 166/334.1, 331, 373, 386, 334.4

[56] References Cited

U.S. PATENT DOCUMENTS

| | | | |
|---|---|---|---|
| 2,155,609 | 4/1939 | McClendon et al. | 166/1 |
| 2,602,510 | 7/1952 | Baker | 166/156 X |
| 2,741,314 | 4/1956 | Deters | 166/156 X |
| 2,791,279 | 5/1957 | Clark | 166/225 |
| 2,846,015 | 8/1958 | Pittman | 166/224 |
| 2,847,074 | 8/1958 | Maly et al. | 166/224 |
| 2,928,470 | 3/1960 | Baker | 166/154 |
| 2,947,363 | 8/1960 | Sackett et al. | 166/154 X |
| 2,998,075 | 8/1961 | Clark | 166/154 X |
| 3,338,311 | 8/1967 | Conrad | 166/154 |
| 3,385,370 | 5/1968 | Knox et al. | 166/225 |
| 3,527,297 | 9/1970 | Todd | 166/154 |
| 3,559,734 | 2/1971 | Pitts | 166/320 |
| 3,633,671 | 1/1972 | Nelson | 166/224 |
| 4,103,739 | 8/1978 | Hall | 166/105 |
| 4,162,691 | 7/1979 | Perkins | 137/613 |
| 4,590,998 | 5/1986 | Hopper | 166/331 |
| 4,664,192 | 5/1987 | Hogarth | 166/291 |
| 4,880,058 | 11/1989 | Lindsey et al. | 166/154 X |
| 5,040,606 | 8/1991 | Hopper | 166/332 |
| 5,234,052 | 8/1993 | Coone et al. | 166/155 |
| 5,472,053 | 12/1995 | Sullaway et al. | 166/327 |
| 5,597,016 | 1/1997 | Manke et al. | 138/46 |
| 5,641,021 | 6/1997 | Murray et al. | 166/291 |
| 5,960,881 | 10/1999 | Allamon et al. | 166/291 |

FOREIGN PATENT DOCUMENTS

WO 98/48143 10/1998 WIPO .

OTHER PUBLICATIONS

Four pages from a 1958 Halliburton Sales and Service Catalog.

Three pages from a 1960 Halliburton Sales and Service Catalog.

*Primary Examiner*—Roger Schoeppel

*Attorney, Agent, or Firm*—Craig W. Roddy; Anthony L. Rahhal

[57] ABSTRACT

The present invention relates to a drill string diverter apparatus for reducing surge pressure when lowering a liner into a partially cased wellbore. The diverter apparatus is connected in a pipe string above a liner being lowered into a wellbore. The diverter apparatus includes a tubular housing with ports defined therethrough to communicate and redirect fluids received in the liner to the annulus between the diverter apparatus and casing previously set in the wellbore. The diverter apparatus has an open position whereby the ports are open and communication is established and a closed position whereby flow through the ports is prevented. A sliding sleeve is disposed about an outer surface of the tubular housing and engages the casing. The sleeve moves vertically relative to the tubular housing once the diverter apparatus has been lowered into the casing to selectively open and close the flow ports. A J-slot means is provided for locking the diverter apparatus in its closed position.

19 Claims, 9 Drawing Sheets

DRILL STRING DIVERTER APPARATUS AND METHOD

BACKGROUND OF THE INVENTION

The present invention relates generally to a diverter apparatus and methods and more particularly to a drill string diverter apparatus which will redirect fluids that have entered a casing string while the casing string is run into a wellbore.

In the construction of oil and gas wells, a wellbore is drilled into one or more subterranean formations or zones containing oil and/or gas to be produced. The wellbore is typically drilled utilizing a drilling rig which has a rotary table on its floor to rotate a pipe string during drilling and other operations. During a wellbore drilling operation, drilling fluid (also called drilling mud) is circulated through a wellbore by pumping it down through the drill string, through a drill bit connected thereto and upwardly back to the surface through the annulus between the wellbore wall and the drill string. The circulation of the drilling fluid functions to lubricate the drill bit, remove cuttings from the wellbore as they are produced and exert hydrostatic pressure on the pressurized fluid containing formations penetrated by the wellbore to prevent blowouts.

In most instances, after the wellbore is drilled, the drill string is removed and a casing string is run into the wellbore while maintaining sufficient drilling fluid in the wellbore to prevent blowouts. The term "casing string" is used herein to mean any string of pipe which is lowered into and cemented in a wellbore including but not limited to surface casing, liners and the like. As is known in the art, the term "liner" simply refers to a casing string having a smaller outer diameter than the inner diameter of a casing that has already been cemented into a portion of a wellbore.

During casing running operations, the casing string must be kept filled with fluid to prevent excessive fluid pressure differentials across the casing string and to prevent blowouts. Heretofore, fluid has been added to the casing string at the surface after each additional casing joint is threadedly connected to the string and the casing string is lowered into the wellbore. Well casing fill apparatus have also been utilized at or near the bottom end of the casing string to allow well fluid in the wellbore to enter the interior of the casing string while it is being run.

One purpose for allowing wellbore fluid to enter the casing string at the end thereof is to reduce the surge pressure on the formation created when the casing string is run into the wellbore. Surge pressure refers to the pressure applied to the formation when the casing being run into the wellbore forces wellbore fluid downward in the wellbore and outward into the subterranean formation. One particularly useful casing fill apparatus is disclosed in U.S. Pat. No. 5,641,021 to Murray et al., assigned to the assignee of the present invention, the details of which are incorporated herein by reference. Although such casing fill apparatus work well to reduce surge pressure, there are situations where surge pressure is still a problem.

Liners having an outer diameter slightly smaller than the inner diameter of casing that has previously been cemented in the wellbore are typically lowered into a partially cased wellbore and cemented in the uncased portion of a wellbore. The liner is lowered into the wellbore so that it extends below the bottom end of the casing into the uncased portion of the wellbore. Once a desired length of liner has been made up, it is typically lowered into the wellbore utilizing a drill string that is connected to the liner with a liner running tool.

The liner will typically include a well casing fill apparatus so that as the liner is lowered into the wellbore, wellbore fluids are allowed to enter the liner at or near the bottom end thereof.

Because the drill string has a much smaller inner diameter than the liner, the formation may experience surge pressure as the fluid in the liner is forced to pass through the transition from the liner to the drill string and up the smaller diameter drill string. Thus, there is a continuing need for an apparatus that will reduce the surge pressure on the formation when lowering a liner into a wellbore.

SUMMARY OF THE INVENTION

The above-mentioned needs are met by the diverter apparatus of the present invention. The drill string diverter apparatus of the present invention comprises a tubular housing defining a longitudinal central flow passage, and having at least one flow port and preferably a plurality of flow ports defined therethrough intersecting the longitudinal central flow passage. The tubular housing has an upper and lower end with an adapter threadedly connected at each end for connecting to a drill string or other pipe string thereabove and a liner running tool therebelow. A diverter apparatus is connected in the pipe string which is disposed in a wellbore. Preferably, the wellbore has a cased portion having a casing cemented therein. The tubular housing and casing define an annulus therebetween.

The diverter apparatus of the present invention further comprises a means for selectively alternating between an open position wherein fluid may be communicated between the central flow passage and the annulus defined between the tubular housing and the casing in the wellbore through the flow ports, and a closed position wherein communication through the flow ports is blocked. A locking means for locking the diverter apparatus in the closed position to prevent the diverter from being inadvertently alternated back to the open position is also provided.

The means for selectively alternating preferably comprises a closing sleeve slidably disposed along an operating length of the tubular housing. More preferably, the closing sleeve is disposed about an outer surface of the tubular housing and is slidable between the open and closed positions.

The closing sleeve has an outer diameter such that when the diverter apparatus is lowered into the wellbore, the casing disposed therein will engage the closing sleeve and hold the closing sleeve in place. Preferably, the closing sleeve is a closing sleeve assembly comprising a tubular sliding sleeve having a plurality of drag springs disposed about the outer surface thereof. The casing will engage the drag springs and urge the drag springs inwardly so that the sliding sleeve is held in place as the tubular housing, along with the remainder of the drill string, is moved vertically in the wellbore. Typically, the diverter apparatus will be in its closed position wherein the sliding sleeve covers the flow ports to prevent communication therethrough prior to the time the diverter apparatus is lowered into the wellbore. When the tubular housing is lowered into the casing, the casing will engage the drag springs so that the tubular housing will move downwardly as the casing holds the sliding sleeve in place. The flow ports defined through the tubular housing will move downward relative to the sliding sleeve and will be uncovered such that communication between the annulus and the central opening of the tubular housing is established. The closing sleeve, although it stays stationary along the operating length of the tubular housing can be said to move vertically relative to the tubular housing along the operating length thereof as the tubular housing moves vertically within the casing. Once the sliding sleeve reaches the upper limit of the operating length, it will move downwardly with the tubular housing and will stay in the open position. To move the diverter apparatus from the open to the closed position, downward movement is stopped and an upward pull is applied so that the tubular housing moves upwardly relative to the sliding sleeve until the sliding sleeve reaches the lower end of the operating length, wherein the sliding sleeve covers the flow ports thus placing the diverter apparatus back in the closed position.

The locking means for locking the diverter apparatus in the closed position preferably comprises a J-slot defined on the outer surface of the tubular housing such that the diverter apparatus can be locked in the closed position simply by rotating the pipe string at the wellhead.

Thus, when the liner is being run into the wellbore, and the diverter apparatus is in the open position, fluid can be communicated from the liner through the liner running tool into the tubular housing and out the flow ports into the annulus between the tubular housing and the previously set casing. By providing an outlet for the fluid in the liner, surge pressure on the wellbore can be reduced. The diverter apparatus therefore provides a method for reducing surge pressure on a formation during running of a liner into the wellbore.

It is thus an object of the invention to provide a means for reducing surge pressure on a formation and for reducing running time when lowering a liner into a partially cased wellbore. Another object of the present invention is to provide a diverter apparatus which can be selectively alternated between and open and closed position for selectively allowing and blocking communication between the central flow passage of a pipe string and an annulus between the pipe string and a casing cemented in the wellbore. It is another object of the invention to provide a drill string diverter apparatus for reducing surge pressure on a wellbore which can be locked in a closed position to prevent the inadvertent reopening and reestablishment of communication between the annulus and the drill string. Other objects and advantages will be apparent from the description and the drawings set forth herein.

DETAILED DESCRIPTION OF THE PREFERRED EMBODIMENT

Figure 1:
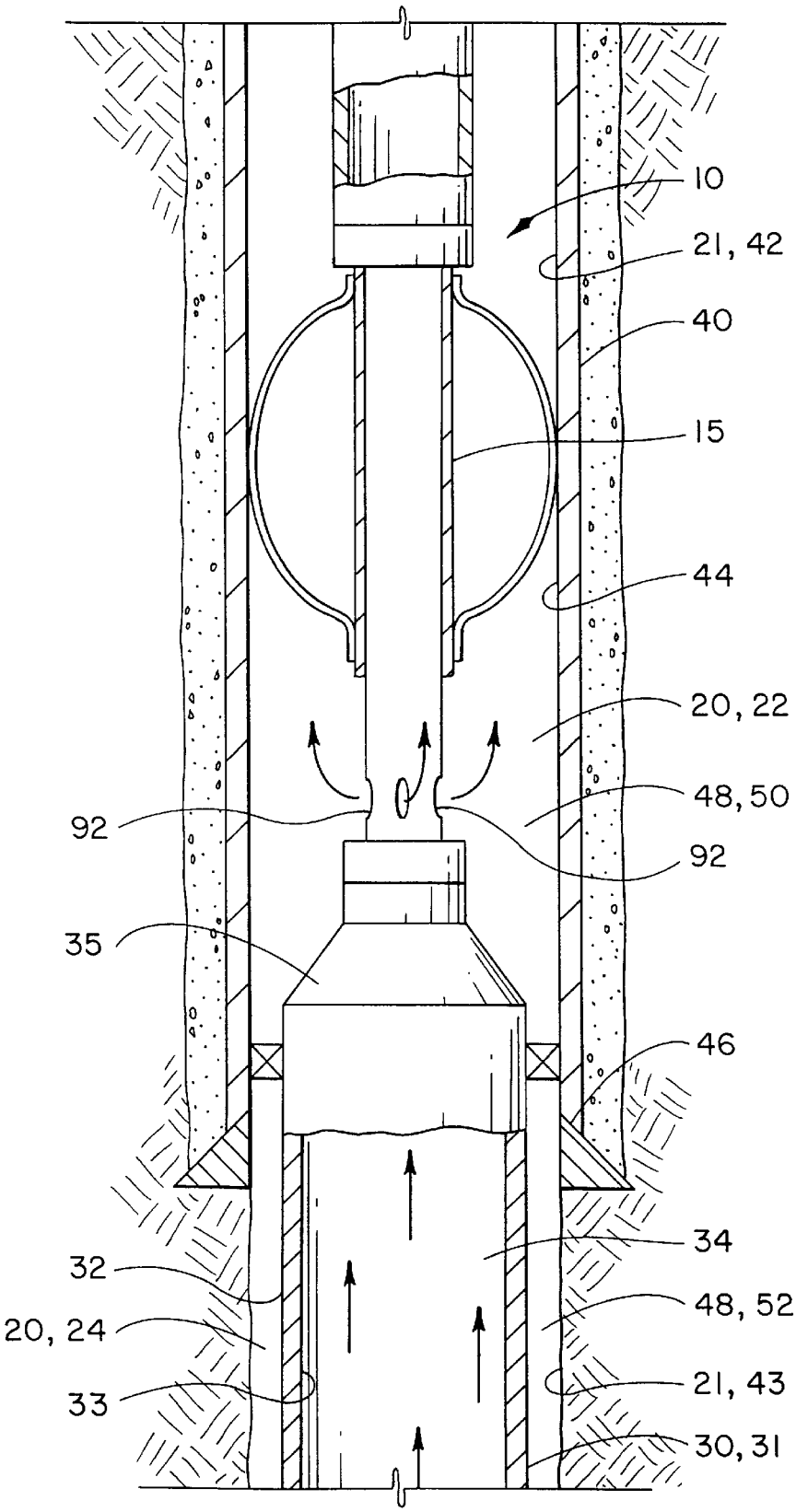
FIG. 1 shows a schematic of the drill string diverter of the present invention disposed in a wellbore.

Referring now to the drawings and more specifically to FIG. 1, a pipe string 10, including a drill string diverter 15 of the present invention, is shown schematically disposed in a wellbore 20 having a wellbore side or wall 21. Wellbore 20 has a cased portion 22 and an uncased portion 24. Pipe string 10 may include a drill string 25 connected at its lower end 27 to drill string diverter 15. Pipe string 10 may also include a liner 30 connected to drill string diverter 15 with a liner running tool 35. Liner 30 has outer surface 31 defining an outer diameter 32, and has inner diameter 33 defining a central opening 34.

Cased portion 22 of wellbore 20 includes a casing 40 cemented therein. Casing 40 has an inner surface 42 defining an inner diameter 44, and a lower end 46. As will be understood by those skilled in the art, wellbore 20 will typically be cased from lower end 46 of casing 40 to the surface. Thus, side 21 of wellbore 20 is defined in cased portion 22 of the wellbore by inner surface 42 of casing 40 and in uncased portion 24 is defined by the wall 43 of the uncased wellbore below the lower end 46 of casing 40. An annulus 48 is defined between pipe string 10 and the side 21 of wellbore 20. Annulus 48 is comprised of an upper annulus 50 and a lower annulus 52. Upper annulus 50 is defined between the inner surface 42 of casing 40 and the portion of pipe string 10 disposed therein. Lower annulus 52 is defined between the side 43 of the uncased wellbore and the outer surface 31 of liner 30.

As is apparent from the schematic, upper annulus 50 between liner 30 and casing 40 has a much narrower width than upper annulus 50 between drill string 25 and casing 40 and between drill string diverter 15 and casing 40. As will be explained in more detail herein, liner 30 has a means by which wellbore fluid can enter the liner. The wellbore fluid will travel upwardly in the direction of the arrows shown in FIG. 1 through central opening 34 and will pass through liner running tool 35 into drill string diverter 15. The wellbore fluid then may be communicated with upper annulus 50 through drill string diverter 15 above liner 30.

Figure 2A:
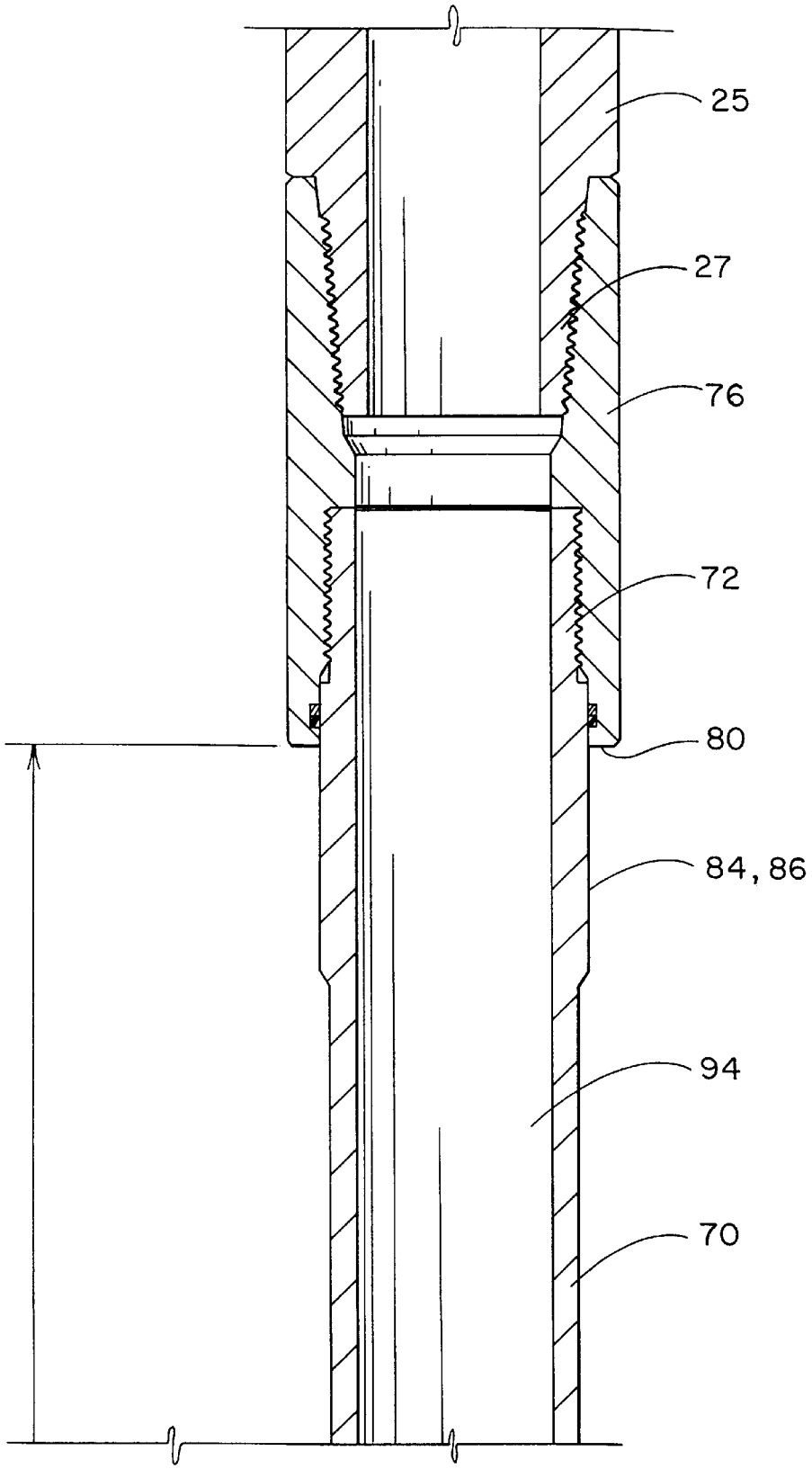
FIGS. 2A–2C show an elevation section view of the drill string diverter of the present invention in a closed position.
Figure 2B:
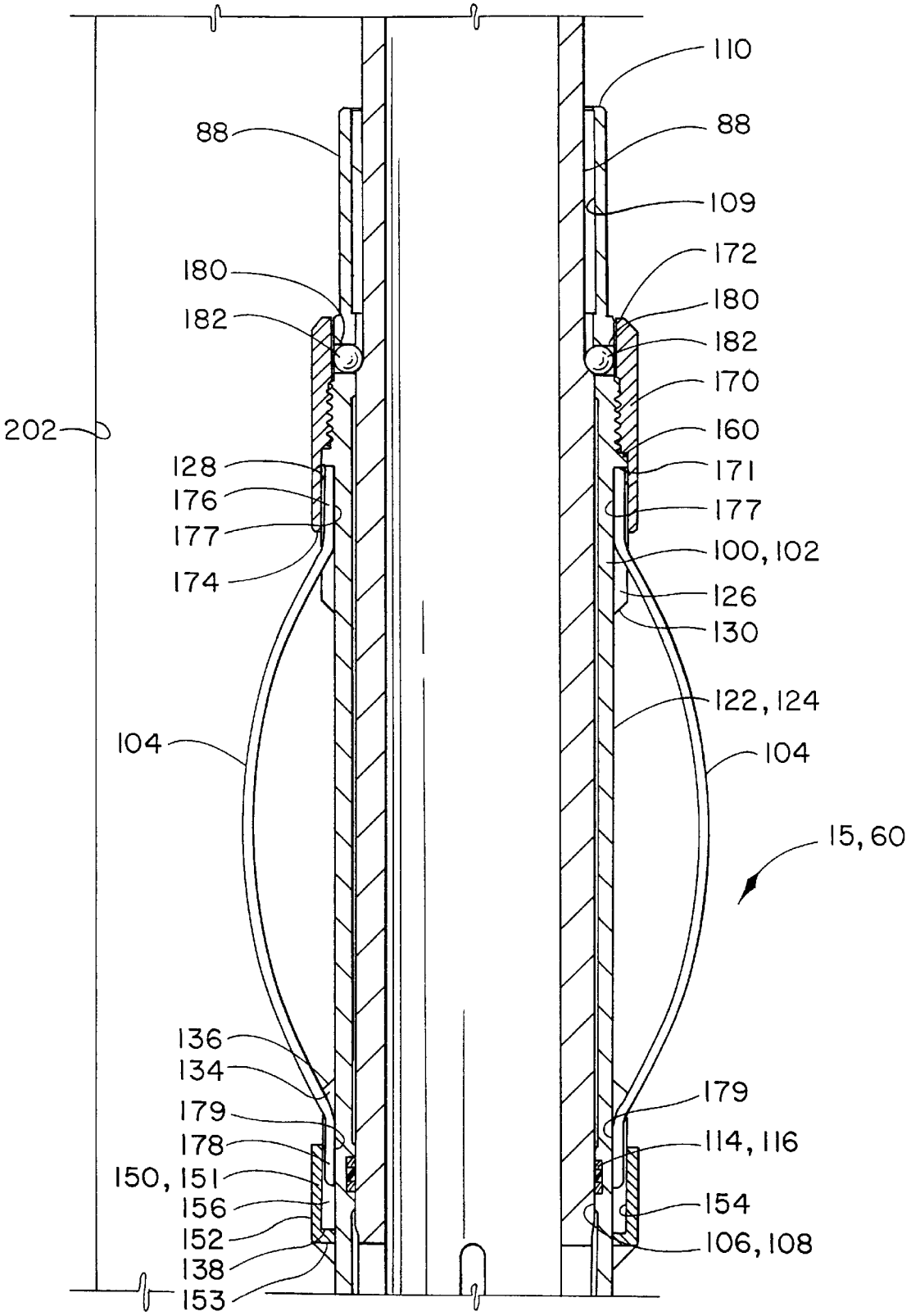
Figure 2C:
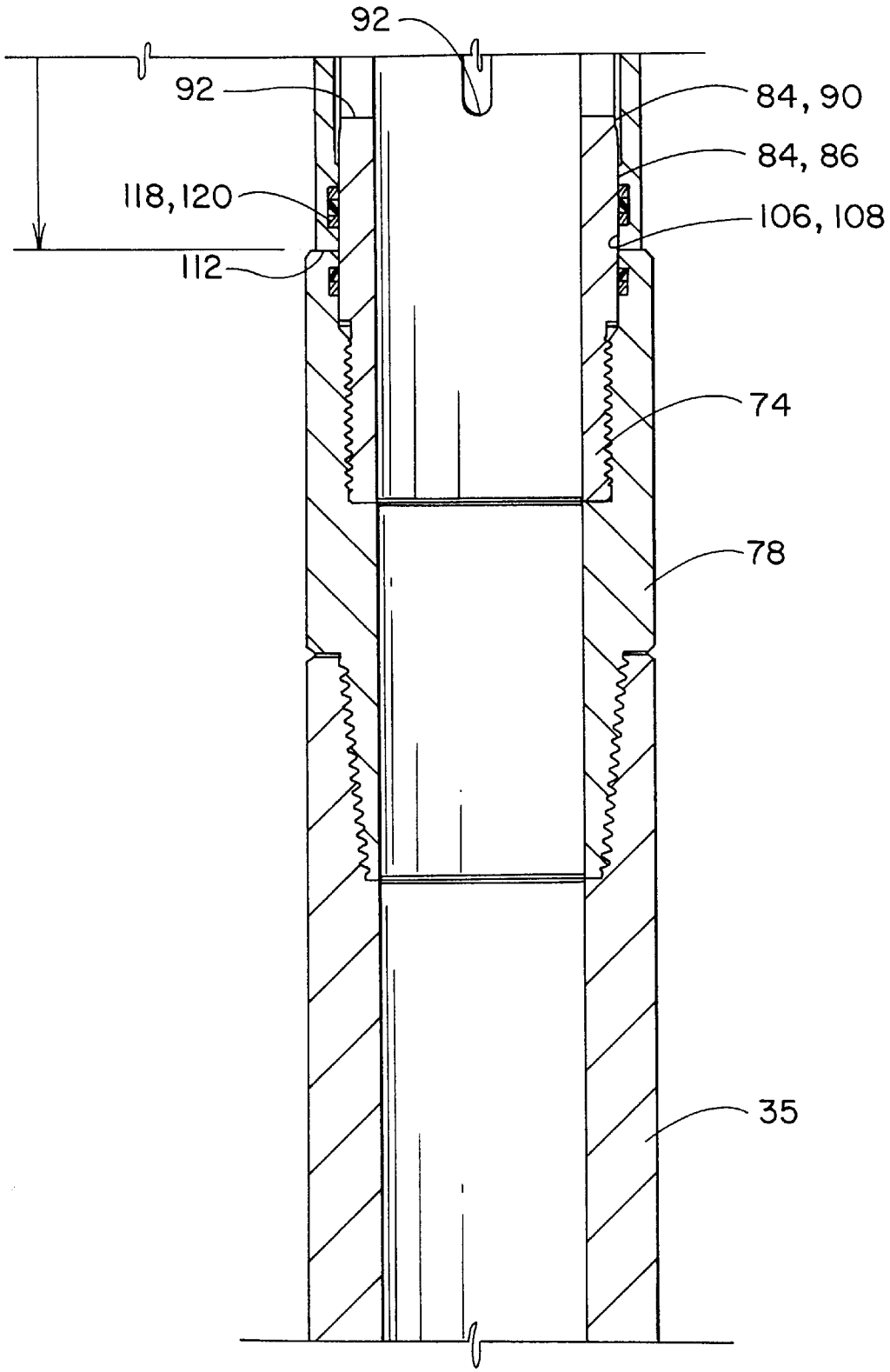
Figure 3A:
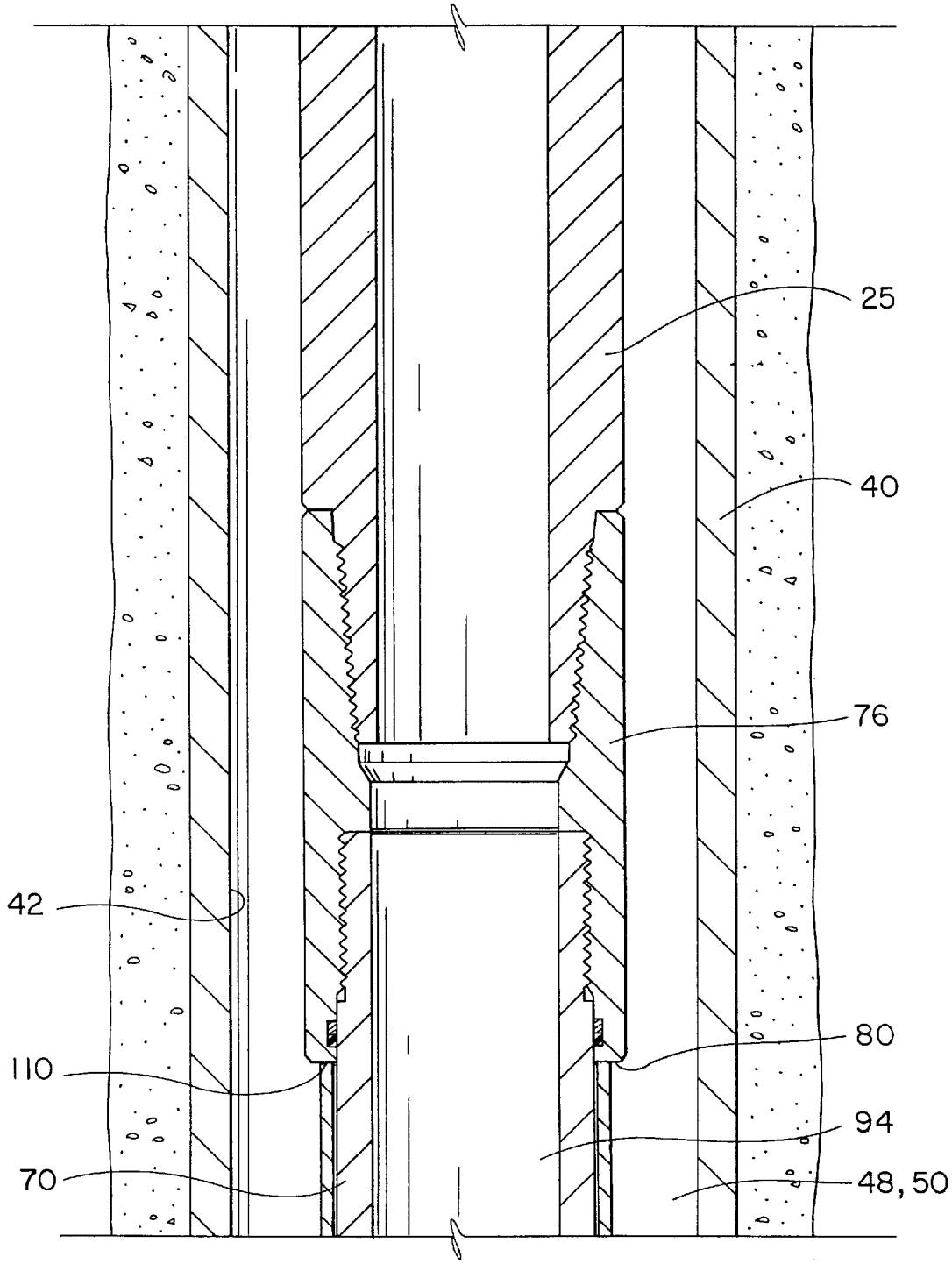
FIGS. 3A–3C show an elevation section view of the drill string diverter of the present invention in an open position in a cased wellbore.
Figure 3B:
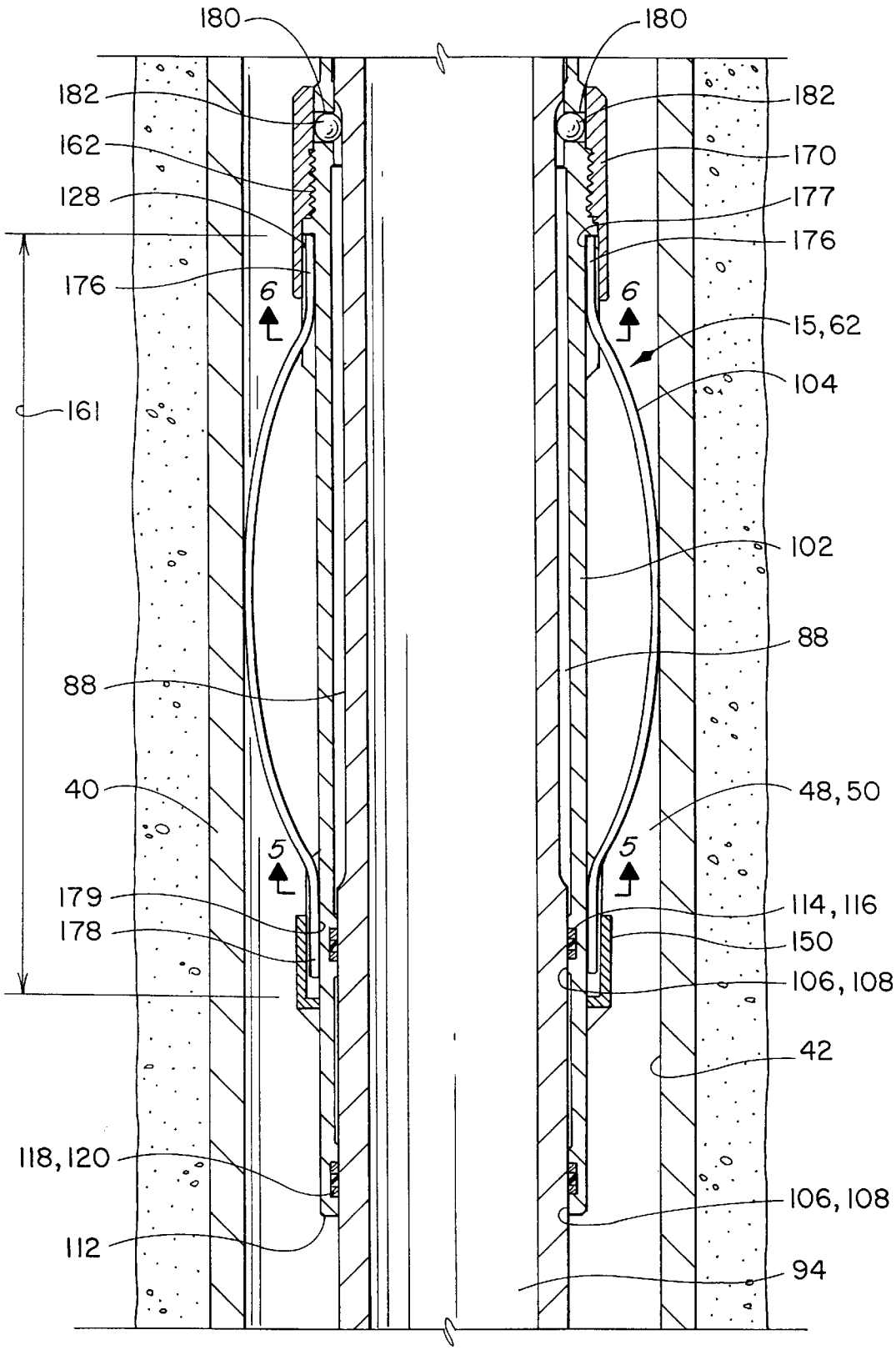
Figure 3C:
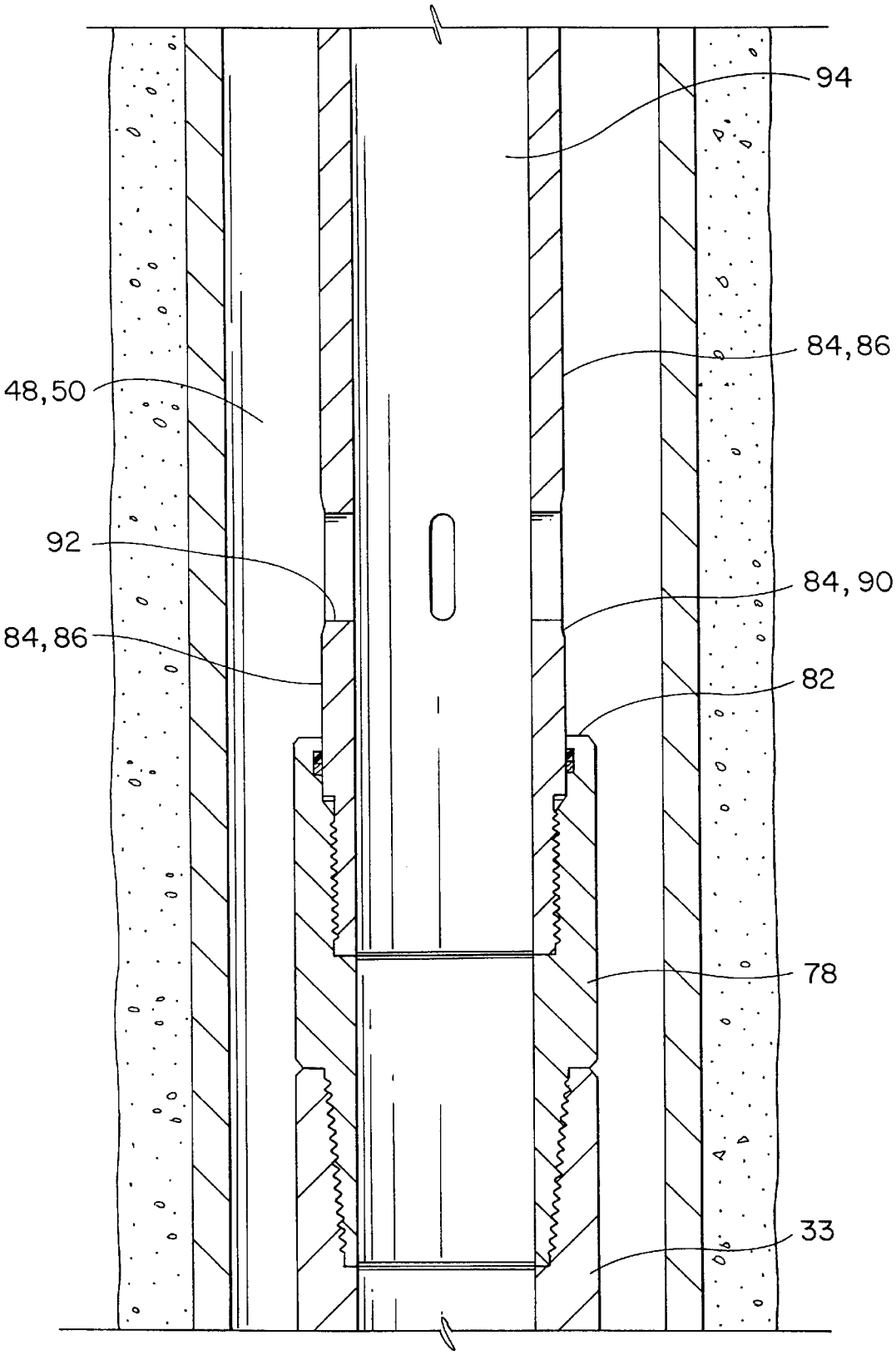

Referring now to FIGS. 2A–2C and FIGS. 3A–3C, diverter tool 15 is shown in its closed position 60 and its open position 62 respectively. FIGS. 3A–3C show the diverter apparatus disposed in casing 40. Diverter apparatus 15 comprises a tubular housing, or mandrel 70 having an upper end 72 and a lower end 74. Upper end 72 has threads thereon and is threadedly connected to an upper adapter 76. Likewise, lower end 74 is threadedly connected to a lower adapter 78. Upper adapter 76 is adapted to be connected to drill string 25 or other string of pipe thereabove. Lower adapter 78 is adapted to be connected to a crossover and liner running tool 35 and thus to liner 30. Although diverter apparatus 15 is shown as being connected at the lower end of drill string 25, drill string diverter 15 may be connected anywhere in a drill string so that several lengths of drill pipe or other pipe may be connected to lower adapter 78 and then connected to liner running tool 35. Adapter 76 defines a shoulder 80 and lower adapter 78 defines an upper end or shoulder 82, both of which extend radially outwardly from tubular housing 70.

Figure 4:
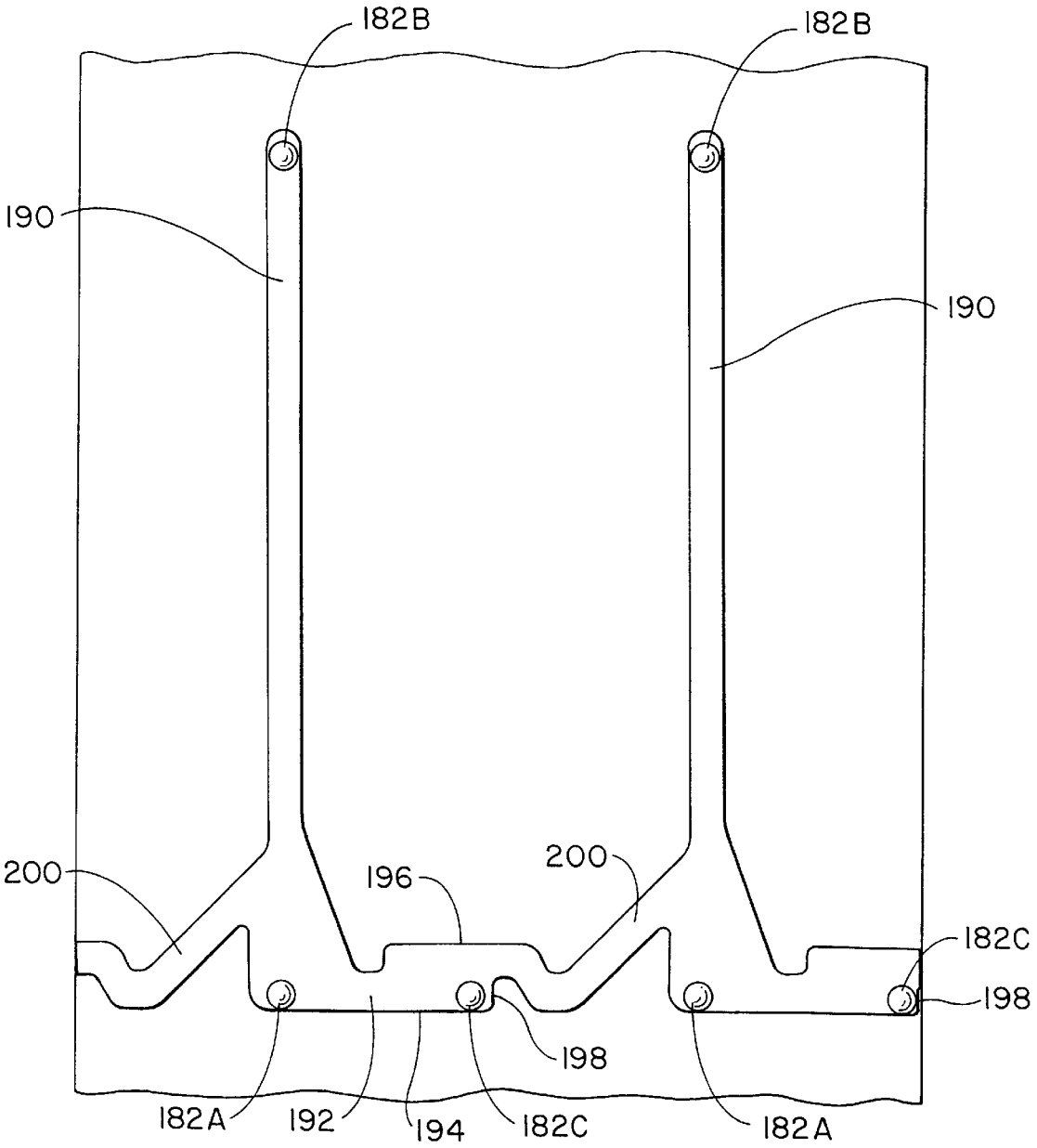
FIG. 4 shows a development of a J-slot in the tubular housing.

Tubular housing 70 has an outer surface 84 defining a first outer diameter 86. At least one, and preferably two J-slots 88 are defined in outer surface 84. A development of the J-slots is shown in FIG. 4 and will be explained in more detail hereinbelow. Outer surface 84 also has a recessed diameter 90 radially recessed inwardly from outer diameter 86.

A plurality of flow ports 92 and preferably four flow ports 92 are defined through tubular housing 70 at recessed surface 90. Flow ports 92 are preferably spaced equally radially around tubular housing 70 and are located near lower end 74 thereof. Flow ports 92 intersect a central opening 94 defined by tubular housing 70. Central opening 94 is communicated with central opening 34 of liner 30 so that wellbore fluid entering liner 30 can pass upwardly therethrough into central opening 94, and when diverter 15 is in the second or open position 62 as depicted in FIGS. 3A–3C and in the schematic in FIG. 1, the wellbore fluid can pass through flow ports 92 into annulus 48 between tubular housing 70 and casing 40.

Diverter tool 15 further comprises a closing sleeve 100 disposed about tubular housing 70. Closing sleeve 100 comprises a tubular closing sleeve member 102, which may be referred to as a sliding sleeve 102 and a plurality of drag springs 104 disposed about tubular closing sleeve member 102. The embodiment shown includes eight drag springs. However, more or less than eight drag springs may be used.

Closing sleeve member 102 is sealingly and slidably received about tubular housing 70. Preferably, closing sleeve member 102 has an inner surface 106 defining a first inner diameter 108 that is slidably and sealingly disposed about outer surface 84, and has an upper end 110 and a lower end 112. Inner surface 106 defines a second inner diameter 109 at upper end 110 stepped radially outwardly from diameter 108. A lower seal 118 is disposed in a groove 120 defined on inner surface 106 of tubular closing sleeve 102 near lower end 112 thereof. An upper seal 114 is disposed in a groove 116 defined above groove 120 on the inner surface 106 of tubular closing sleeve 102. Lower seal 118 sealingly engages outer surface 84 of tubular closing sleeve 102 below ports 92 and upper seal 114 sealingly engages surface 84 above flow ports 92 when diverter apparatus 15 is in closed position 60. Thus, tubular closing sleeve 102 of closing sleeve assembly 100 sealingly engages tubular housing 70 above and below flow ports 92 and covers flow ports 92 when the diverter is in closed position 60 so that communication between central opening 94 and annulus 48 through flow ports 92 is prevented.

Figure 5:
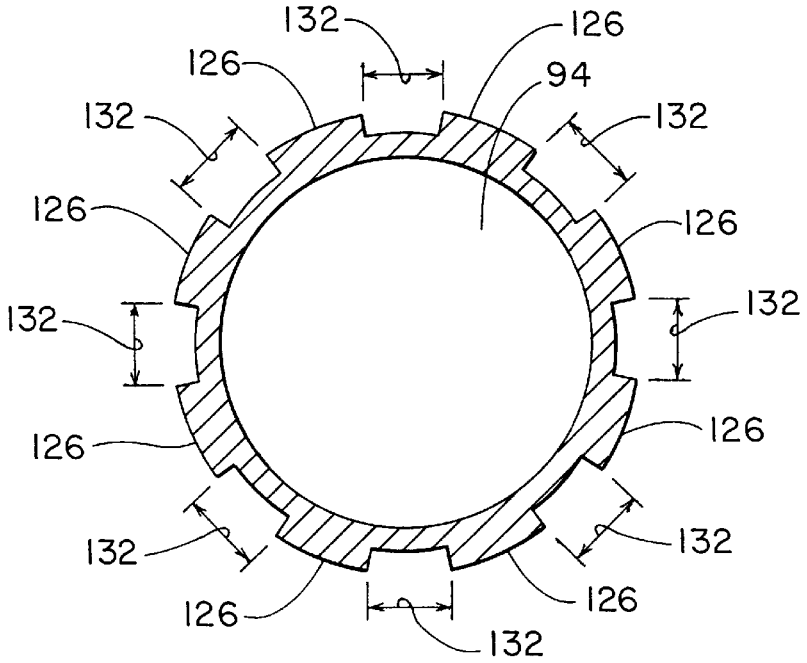
FIG. 5 is a section view of the tubular housing of the present invention taken from line 5—5 of FIG. 3B.
Figure 6:
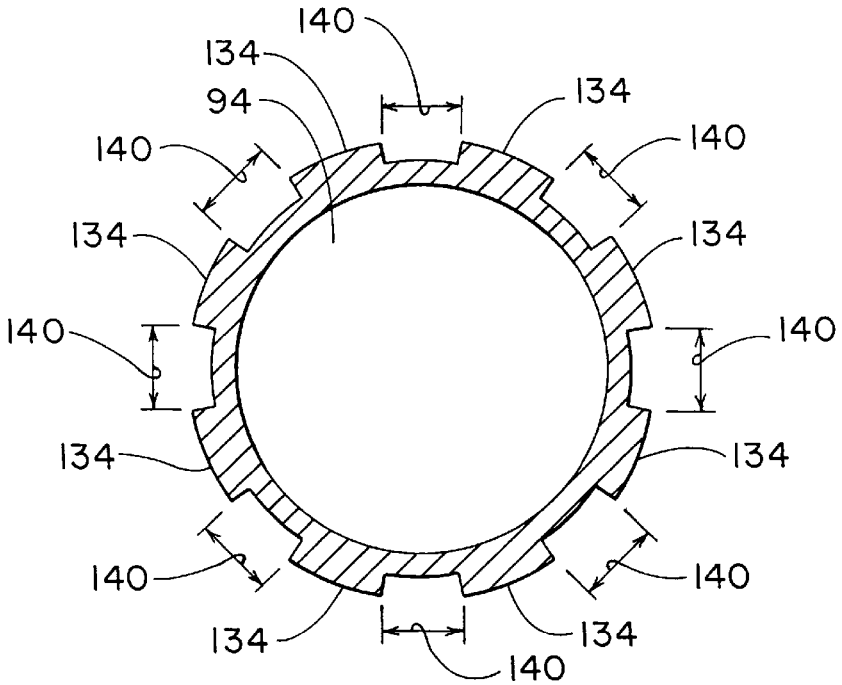
FIG. 6 is a section view of the tubular housing of the present invention taken from line 6—6 of FIG. 3B.

Closing sleeve member 102 has an outer surface 122 defining a first outer diameter 124. A plurality of upper spring alignment lugs 126 are defined by outer surface 122 and extend radially outwardly from outer diameter 124. Lugs 126 have an upper end 128 and a lower end 130. As better seen in FIG. 5, lugs 126 are radially spaced around tubular closing sleeve member 102 and define a plurality of spaces 132. A plurality of lower spring alignment lugs 134 are likewise defined by outer surface 122 and extend radially outwardly from first outer diameter 124. Lower lugs 134 have an upper end 136 and a lower end 138. As better seen in FIG. 6, lugs 134 are radially spaced about tubular closing sleeve 102 and define a plurality of spaces 140 therebetween. Preferably, there are eight upper lugs 126 and eight lower lugs 134 and thus eight spaces 132 and 140 respectively.

A lower spring retainer 150 is connected to outer surface 122 of tubular closing sleeve 102. Lower spring retainer 150 is substantially cylindrical and has an outer surface 152 and an inner surface 154. Lower spring retainer 150 is connected to and is preferably welded to the outer surface 122 of the tubular closing sleeve 102. Lower spring retainer 150 preferably has an L-shaped cross section with a vertical leg 151 and a horizontal leg 153. An annulus 156 is defined between leg 151 and outer surface 122 of closing sleeve 102.

A circular lug 160 is defined by outer surface 122 above spring alignment lugs 126. Circular lug 160 extends about the circumference of tubular housing 70 and is stepped radially outwardly from outer diameter 124. A distance 161 is defined between lug 160 and leg 153 of lower spring retainer 150. Outer surface 122 has threads 162 defined thereon above lug 160. A spring retaining sleeve 170 having an upper end 172 and a lower end 174 is threadedly connected to tubular closing sleeve 102 at threads 162 above circular lug 160. Retaining sleeve 170 extends downwardly past circular lug 160 and over a portion of upper spring alignment lugs 126. An annulus 171 is defined between retaining sleeve 170 and outer surface 122 of sliding sleeve 102 below circular lug 160. Drag springs 104 are disposed about tubular sliding sleeve 102, and as explained in more detail hereinbelow, drag springs 104 are connected to sliding sleeve 102 by placing the upper and lower ends thereof in annulus 171 and annulus 156, respectively.

Each drag spring 104 has an upper end 176 and a lower end 178, having engagement surfaces 177 and 179 respectively defined thereon. Surfaces 177 and 179 engage outer surface 122 of closing sleeve 102. Upper ends 176 of drag springs 104 are received in spaces 132 and lower ends 178 are received in spaces 140, and preferably have a uniform width. Upper ends 176 of drag springs 104 are received in annulus 171 and lower end 178 of drag springs 104 are received in annulus 156.

A pair of holes or ports 180 are defined through tubular closing sleeve 102 above threads 162. Each hole 180 has a spherical ball 182 received therein. Balls 182 are received in J-slots 88 and are covered by and thus held in J-slots 88 by retaining sleeve 170 which extends upwardly past holes 180.

Balls 182 are movable in J-slots 88 which are shown better in FIG. 4. J-slots 88 include a vertical slot 190 and a landing portion 192 having a lower edge 194, an upper edge 196 and a locking shoulder 198. J-slot 88 also includes an angular transition slot 200 extending from landing portion 192 to vertical slot 190.

Referring now to the schematic shown in FIG. 1, diverter 15 may be used in a pipe string 10 which comprises liner 30 and drill string 25 connected thereabove. Although the pipe string is designated as drill string 25 above liner 30, it is to be understood that the term drill string, when used in such context refers to any type of pipe string having a smaller outer diameter than the liner and utilized to lower the liner into the wellbore. Once the desired length of liner 30 has been made up, it is typically lowered through casing 40 and into the open uncased wellbore therebelow with drill string 25 or other string of pipe having a diameter smaller than the outer diameter 32 of liner 30. In the embodiment shown, drill string diverter 15 is connected to the liner running tool 35, but may be connected thereabove in drill string 25.

As is well known in the art, casing fill apparatus such as that shown in U.S. Pat. No. 5,641,021, issued Jun. 24, 1997, to Murray et al., the details of which are incorporated herein by reference, are used in liners to allow the liner to fill with wellbore fluid while it is being run into the wellbore. Although the fill apparatus described therein is particularly useful with the present invention, the diverter apparatus 15 may be used in combination with any type of fill apparatus that allows wellbore fluid into a liner as it is being run into a wellbore. One purpose of allowing wellbore fluid into the liner is to reduce surge pressure on the formation. Surge pressure refers to the pressure applied by the liner to the wellbore fluid which forces the wellbore fluid into the formation.

When drill string diverter 15 is lowered into the wellbore, it will be engaged by casing 40 as shown in FIGS. 1 and 3A–3C. Casing 40 will compress, or urge drag springs 104 inwardly so that engagement surfaces 177 and 179 tightly grasp sliding sleeve 102. As shown in FIGS. 3A–3C, the overall length of the drag spring from its upper end to its lower end is less than distance 161, so that when casing 40 initially engages drag springs 104, ends 176 and 178 can move vertically along outer surface 122 as radially inwardly directed forces are applied to closing sleeve member 102 by drag springs 104. Once drag springs 104 are engaged by casing 40, the force applied to closing sleeve member 102 thereby is such that sleeve member 102 will be held in place by the drag springs. Thus, as tubular housing 70 moves vertically, closing sleeve 100 is held in place by casing 40 and will move vertically along an operating length 202 relative to tubular housing 70. Operating length 202 spans between lower end 80 of upper adapter 76 and upper end 82 of lower adapter 78. Downward movement of tubular housing 70 in casing 40 will cause tubular housing 70 to move downward relative to tubular closing sleeve member 102, and as such, the closing sleeve member 102 moves vertically upwardly relative to tubular housing 70 along operating length 202.

In closed position 60, spherical balls 182 are located at positions 182A as shown in FIG. 2B and FIG. 4. When diverter 15 moves to open position 62, communication between central opening 94 and annulus 48 is established through ports 92. Diverter 15 is moved to open position 62 from closed position 60 by lowering pipe string 10, and thus tubular housing 70 in casing 40. As tubular housing 70 moves downwardly, springs 104 are engaged by casing 40 so that closing sleeve 102 is held in place and ports 92 are uncovered. As pipe string 10 continues to move downwardly, tubular housing 70 will move relative to closing sleeve member 102 until upper end 120 thereof engages lower end 80 of upper adapter 76. When ends 86 and 120 are engaged, spherical balls 182 will be in position 182B as shown in FIG. 4, and closing sleeve member 102 will move downwardly as tubular housing 70 moves downwardly and will stay in open position 62. When tubular housing has moved downward so that ports 92 are uncovered, fluid that has entered liner 30 and is communicated with central opening 94 may exit through ports 92 into annulus 48 between tubular housing 70 and casing 40. In the absence of such ports, the transition from liner 30 to the smaller diameter drill pipe, along with friction created by the smaller diameter drill pipe can increase surge pressure. Thus, diverter apparatus 15 acts as a means for reducing surge pressure on a subterranean formation.

If, during the lowering of liner 30 into the wellbore it is desired to close ports 92 for any reason upward pull can be applied at the surface which will cause upward movement of tubular housing 70 in casing 40 relative to closing sleeve 100. When upward pull is applied, tubular closing sleeve member 102 will be held in place by drag springs 104 and casing 40, and will move downward relative to tubular housing 70 along operating length 202 to closed position 60, wherein lower end 112 of tubular closing sleeve member 102 engages upper end 82 of lower adapter 78, and spherical balls 182 will move vertically in slots 190 to position 182A as shown in FIG. 4. Once end 112 engages upper end 82 of lower adapter 78, closing sleeve 100 will move upwardly along with tubular housing 70. In closed position 60, closing sleeve 102 covers ports 92 and blocks ports 92 so that communication therethrough between central opening 94 and annulus 48 is prevented. Diverter apparatus 15 can be moved once again to open position 62 simply by lowering the pipe string, and thus tubular housing 70, downwardly in casing 40 to move sleeve 102 upwardly relative thereto so that ports 92 are uncovered and communication between central opening 94 and annulus 48 is permitted therethrough. Thus, sleeve assembly 100 comprises a means for selectively alternating diverter apparatus 15 between an open position wherein fluid may be communicated between central opening 94 and annulus 48 through flow ports 92, and a closed position wherein closing sleeve 100 covers ports 92 so that flow therethrough is blocked.

When liner 30 reaches the desired depth in wellbore 20, diverter apparatus 15 may be locked in closed position 60 so that flow through ports 92 is blocked, and accidental, or inadvertent reopening is prevented. Liner 30 can then be cemented in the wellbore in typical fashion. To lock diverter apparatus 15 in closed position 60, downward movement of pipe string 10 is stopped and upward pull is applied so that spherical balls 182 move to position 182A along lower edge 194 of landing portion 192 of J-slots 88. Drill string 25 is then rotated until balls 182 engage locking shoulder 198 at position 182C. At position 182C, balls 182 are trapped between upper and lower edges 194 and 196 of landing portion 192 so that closing sleeve 100 will move vertically in casing 40 along with tubular housing 70, and diverter apparatus 15 stays in closed position 60. Thus, the J-slot, spherical ball arrangement provides a locking means for locking diverter 15 in its closed position 60.

If it is desired to unlock the tool while the tool is still in the wellbore, the diverter housing must be manipulated and rotated to the right so spherical balls 182 will pass over locking shoulder 198 into angular transition sleeve 200. Continued rotation will cause balls 182 to follow slot 200 until they are aligned with vertical slots 190 and thus can be moved from position 182A to 182B. Once diverter 15 is locked in closed position 60, it can not be unlocked accidentally, and typically there will be no need to unlock diverter apparatus 15 until it has been removed from the wellbore. However, if necessary, diverter apparatus 15 can be unlocked as described.

The locking means may also comprise a locking sleeve releasably disposed in central opening 94. The locking sleeve would be attached in the tubular housing 70 above ports 92, and would have a seat for accepting a ball or dart. When it is desired to lock the diverter apparatus in its closed position, a ball or dart can be dropped and pressure increased to move the sleeve downward so that it covers ports 92. The tubular housing will have a shoulder or other means for stopping the downward movement of the sleeve. The ball seat within the sleeve must be detachable, or yieldable, so that the ball can be urged therethrough and cement can be flowed therethrough.

After diverter apparatus 15 has been moved to and locked in closed position 60, normal cementing operations can begin. Thus, as described herein, diverter apparatus 15 provides a means for reducing surge pressure when lowering a liner into a wellbore. The method for reducing surge pressure comprises providing a string of pipe having a diverter apparatus 15 connected therein and lowering the pipe string including the diverter apparatus into a wellbore. Surge pressure is reduced by allowing wellbore fluids to flow into the pipe string at a point below the diverter apparatus and by allowing wellbore fluid received in the pipe string to exit the pipe string through ports defined in the diverter apparatus. Such a method reduces surge pressure on a formation and reduces casing running time, thus providing a significant advancement over prior methods.

Although the invention has been described with reference to a specific embodiment, the foregoing description is not intended to be construed in a limiting sense. Various modifications as well as alternative applications will be suggested to persons skilled in the art by the foregoing specification and illustrations. It is therefore contemplated that the appended claims will cover any such modifications, applications or embodiments as followed in the true scope of this invention.

What is claimed is:

1. A diverter apparatus for use in a pipe string to be lowered in a wellbore, said diverter apparatus comprising:

a tubular housing defining a longitudinal central flow passage, said tubular housing having at least one flow port defined therethrough intersecting said longitudinal central flow passage;

means for selectively alternating said diverter apparatus between an open position wherein fluid is communicated between said central flow passage and an annulus defined between said tubular housing and a side of said wellbore through said at least one flow port and a closed position wherein communication through said at least one flow port is blocked; and locking means for locking said diverter apparatus in said closed position to prevent flow through said at least one flow port and to prevent said diverter apparatus from being inadvertently alternated back to said open position.

2. The diverter apparatus of claim 1, said means for selectively alternating said diverter apparatus between an open position and a closed position comprising a closing sleeve slidably disposed along an operating length of said tubular housing, wherein said closing sleeve covers said flow port and prevents communication therethrough when said diverter apparatus is in said closed position and wherein said port is uncovered to allow communication of fluid therethrough when said closing sleeve slides along said operating length to place said diverter apparatus in said open position.

3. The diverter apparatus of claim 2 wherein said closing sleeve is disposed about an outer surface of said tubular housing and is slidable between said open and said closed positions.

4. The diverter apparatus of claim 3, said wellbore having a casing cemented therein adapted to engage and hold said closing sleeve so that as said tubular housing moves downward in said casing said closing sleeve moves upwardly relative thereto along said operating length to said open position, and so that said closing sleeve may be moved to said closed position from said open position by pulling said tubular housing upwardly in said casing.

5. The diverter apparatus of claim 4, said closing sleeve comprising a tubular sliding sleeve disposed about said tubular housing and at least one drag spring mounted to said tubular sliding sleeve, wherein said casing engages said drag spring and urges said drag spring radially inwardly to hold said tubular sliding sleeve so that said tubular sliding sleeve stays substantially stationary along said operating length when said tubular housing moves vertically in said casing.

6. The diverter apparatus of claim 4, wherein said tubular housing has a J-slot defined thereon, said sliding sleeve having an opening defined therein for receiving a spherical ball to slide in said J-slot, said diverter apparatus being locked in said closed position by pulling upwardly on said tubular housing to cause said closing sleeve to move downwardly relative to said housing to said closed position and rotating said tubular housing so that said spherical ball is trapped in a landing portion of said J-slot, thereby preventing vertical movement of said sliding sleeve relative to said tubular housing and locking said diverter apparatus in said closed position.

7. The diverter apparatus of claim 3 wherein said pipe string comprises a liner connected to a string of drill pipe, said drill pipe having an outer diameter less than an outer diameter of said liner, said diverter apparatus being connected to said drill pipe above said liner.

8. The diverter apparatus of claim 7, wherein fluid in said wellbore enters said liner as said liner is lowered into said wellbore and is communicated from said liner into said longitudinal central flow passage of said tubular housing, said wellbore fluid being communicated with an annulus between said housing and said casing through said at least one port.

9. A diverter apparatus for use in a drill string to reduce pressure surges that may occur when a liner connected to said drill string is lowered into a wellbore having a casing cemented in a portion thereof, said diverter apparatus comprising:

a tubular housing defining a longitudinal central flow passage and adapted to be connected to said drill string above said liner, said tubular housing having at least one flow port defined therethrough intersecting said longitudinal central flow passage, said tubular housing and said casing defining an annulus therebetween;

a closing sleeve disposed about an outer surface of said tubular housing and slidable along an operating length thereof between an open position and a closed position, wherein in said open position said at least one flow port is uncovered and said central flow passage is communicated with said annulus, and wherein in said closed position said closing sleeve covers said port and communication therethrough is obstructed; and wherein said casing engages said closing sleeve and holds said closing sleeve so that said tubular housing will move vertically relative to said closing sleeve along said operating length between said open and closed positions to selectively open and close said at least one flow port as said drill string moves vertically in said wellbore.

10. The diverter apparatus of claim 9, wherein said closing sleeve may be moved from said open to said closed position by pulling upwardly on said tubular housing when said tubular housing is disposed in said casing cemented in said wellbore, and wherein said closing sleeve may be moved from said closed to said open position by lowering said tubular housing in said casing.

11. The diverter apparatus of claim 9 wherein a wellbore fluid communicated with said liner as said liner is lowered into said wellbore may be communicated through said at least one flow port into said annulus between said tubular housing and said casing as said diverter apparatus moves downwardly through said casing.

12. The diverter apparatus of claim 9, wherein said closing sleeve comprises a tubular sliding sleeve disposed about said housing and at least one drag spring connected to said tubular sliding sleeve, wherein said casing engages said drag spring when said diverter apparatus is disposed therein.

13. The diverter apparatus of claim 12 wherein said drag spring is urged radially inwardly by said casing when said diverter apparatus is disposed therein to hold said tubular sliding sleeve in place in said casing so that said tubular sliding sleeve will move vertically relative to said tubular housing along said operating length of said tubular housing.

14. A diverter apparatus comprising:

a tubular housing adapted to be connected in a pipe string, said pipe string being connected to a liner and having an outer diameter smaller than an outer diameter of said liner, wherein wellbore fluids communicated with a central opening of said liner as said liner is lowered into a wellbore are communicated with a central flow passage of said tubular housing, said wellbore having a casing disposed therein;

a closing sleeve slidably disposed about said tubular housing and movable between a lower position wherein said closing sleeve covers an at least one flow port defined in said housing to prevent fluid flow therethrough and an upper position wherein said sleeve moves to uncover said at least one flow port so that said wellbore fluids communicated through said liner into said tubular housing may be communicated with an annulus between said tubular housing and said casing through said at least one flow port.

15. The diverter apparatus of claim 14, wherein said casing engages said closing sleeve and holds said closing sleeve so that said tubular housing moves vertically relative to said closing sleeve along an operating length of said tubular housing in said casing.

16. The diverter apparatus of claim 14 wherein said closing sleeve may be moved from said upper position to said lower position by pulling said tubular housing upwardly in said casing.

17. The diverter apparatus of claim 14, wherein said closing sleeve comprises a closing sleeve member having an inner surface sealingly engaging said tubular housing and at least one drag spring connected to said closing sleeve member, said casing engaging said drag spring.

18. The diverter apparatus of claim 17, said drag spring comprising a substantially C-shaped spring having flattened ends, said ends being closely received about an outer surface of said closing sleeve member, wherein said casing deflects said drag spring inwardly so that said ends thereof apply a radially inwardly directed force sufficient to hold said closing sleeve member in place along an operating length of said tubular housing as said tubular housing moves vertically in said casing.

19. The diverter apparatus of claim 14, wherein said diverter apparatus further comprises locking means for locking said closing sleeve in said closed position.

* * * * *